United States Patent [19]

Brownlee

[11] 4,128,223

[45] Dec. 5, 1978

[54] STEP LADDER BRACKET

[76] Inventor: Merrel F. Brownlee, 58 Euclid Ave., Struthers, Ohio 44471

[21] Appl. No.: 780,531

[22] Filed: Mar. 23, 1977

[51] Int. Cl.[2] ..... E06C 7/14

[52] U.S. Cl. ..... 248/211; 182/106; 248/507

[58] Field of Search ..... 182/106, 129; 248/77, 248/78, 125, 154, 210, 211, 238, 318, 507, 508

[56] References Cited

U.S. PATENT DOCUMENTS

| | | | |
|---|---|---|---|
| 245,344 | 8/1881 | Bray | 182/129 X |
| 325,441 | 9/1885 | Pearson | 182/129 X |
| 1,238,286 | 8/1917 | Gross | 248/210 |
| 2,155,097 | 4/1939 | Mendle | 248/125 |
| 2,162,022 | 6/1939 | Mansfield | 248/210 |
| 2,303,078 | 11/1942 | Hull | 182/106 |
| 2,518,214 | 8/1950 | Worthington | 248/154 X |
| 2,544,312 | 3/1951 | Hamilton | 248/210 |
| 2,686,033 | 8/1954 | Keiter | 248/211 |
| 2,834,526 | 5/1958 | Paris | 182/16 |
| 2,907,541 | 10/1959 | Haislip | 248/211 |
| 2,954,093 | 9/1960 | Fitzgerald | 182/129 |
| 3,013,627 | 12/1961 | Haislip | 182/106 |
| 3,160,383 | 12/1964 | Lamm | 248/211 |
| 3,963,096 | 6/1976 | Jones | 182/129 X |

FOREIGN PATENT DOCUMENTS

| | | | |
|---|---|---|---|
| 627519 | 9/1961 | Canada | 182/129 |
| 284548 | 9/1913 | Fed. Rep. of Germany | 182/129 |
| 316240 | 11/1919 | Fed. Rep. of Germany | 182/129 |
| 4542 | 4/1900 | United Kingdom | 248/154 |
| 581092 | 10/1946 | United Kingdom | 248/211 |

*Primary Examiner*—Lawrence J. Staab
*Attorney, Agent, or Firm*—Webster B. Harpman

[57] ABSTRACT

A vertically positioned post detachably affixed to a step ladder has a slotted clamp adjustably positioned thereon for holding the bail of a bucket on the step ladder or alternately engaging the rim of the bucket. The upper end of the post forms a safety handle.

1 Claim, 2 Drawing Figures

STEP LADDER BRACKET

BACKGROUND OF THE INVENTION (1) Field of the Invention

This invention relates to devices on step ladders or the like for engaging and/or holding a paint bucket and providing an elevated safety handle for the convenience of the user of the step ladder.

(2) Description of the Prior Art

Prior structures of this type may be seen in U.S. Pat. Nos. 96,495, 2,162,022, 2,834,526 and 2,907,541. The device of U.S. Pat. No. 96,495 comprises merely a vertically standing post with a hook adjacent its uppermost end. No means selectively engagable with a paint bucket is disclosed as in the case of the present invention.

U.S. Pat. No. 2,162,022 shows a post adjustably clamped to one of the rails of a ladder and carrying a platform and a hook, both of which are adjustable relative thereto, there is no comparable construction in the present invention.

U.S. Pat. No. 2,834,526 shows a vertically adjustable telescopically arranged post for a ladder with a cross arm at the top including a hook. No comparable structure is found in the present invention.

U.S. Pat. No. 2,907,541 shows a vertical past attached to the rail of a step ladder and having a wire clip slidably engaging the past and arranged so that tilting the clip will secure it in adjusted position to the post where it may be used to support the bail of a bucket. There is no comparable slidable friction clip in the present invention.

The present invention detachably mounts a vertical post on the top step or platform of a step ladder and provides a vertically movable clamping member thereon as well as a safety handle for the step ladder.

SUMMARY OF THE INVENTION

A step ladder bracket detachably mounts a vertical post on a step ladder, provides an elevated safety handle for a person using the step ladder and includes a slidable clamp for selective location along the past, the clamp being usable for holding the bail of a bucket positioned on the ladder or alternately directly engaging the lip of the bucket so as to hold it in position on the top step or platform of a step ladder.

DESCRIPTION OF THE PREFERRED EMBODIMENT

Figure 1:
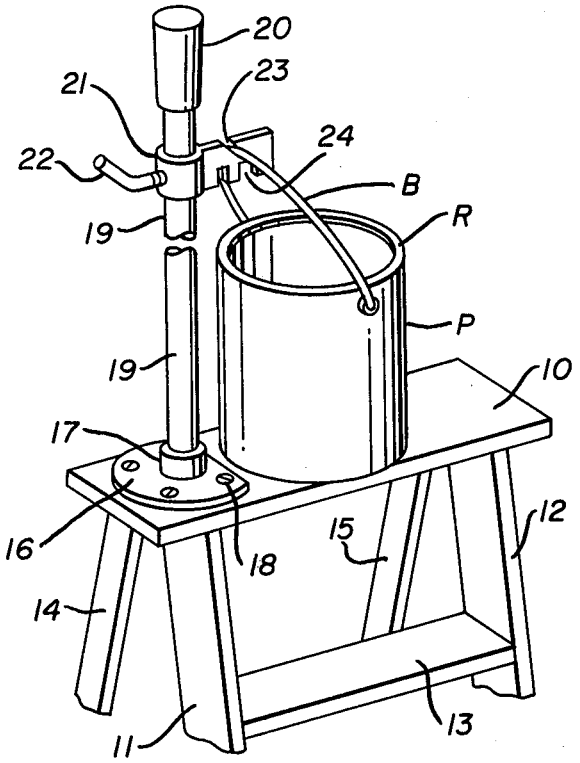
FIG. 1 is a perspective view with parts broken away showing the upper portion of a step ladder with the step ladder bracket installed thereon.

By referring to FIG. 1 of the drawings, the top step or platform 10 of a step ladder may be seen, the ladder rails 11 and 12 having a step 13 therebetween and a pair of legs 14 and 15 are partly illustrated and are pivoted to the platform 10 as will be recognized by those skilled in the art.

A modified floor flange 16 including a vertical socket 17 is attached to the platform 10 of the step ladder by fasteners 18 and a vertical post 19 is detachably engaged in the vertical sockets 17. The upper end of the vertical post 19 has a resilient handle grip 20 thereon so that it forms an elevated safety handle for a person using the step ladder. A vertically adjustable slidable clamp 21 is movably engaged on the vertical post 19 and includes a rotatable threaded clamping arm 22 on one side thereof positioned in a threaded opening in the sliding clamp 21 so as to be engagable with the vertical post 19 to securely position the sliding clamp 21 in desired location on the vertical post 19 when the threaded clamping arm is tightened thereagainst. The sliding clamp 21 extends outwardly and oppositely from the clamping arm 22 and has a plurality of slots 23 and 24 formed in its upper and lowermost surfaces. The slot 23 in its uppermost surface is preferably angularly disposed as illustrated and is particularly adapted to receive a bail B of a paint bucket C which is positioned on the platform 10 of the stepladder. By adjusting the slidable clamp 21 to a position on the post 19 where the bail B is held in tight relation, the paint bucket C is firmly positioned on the stepladder.

Figure 2:
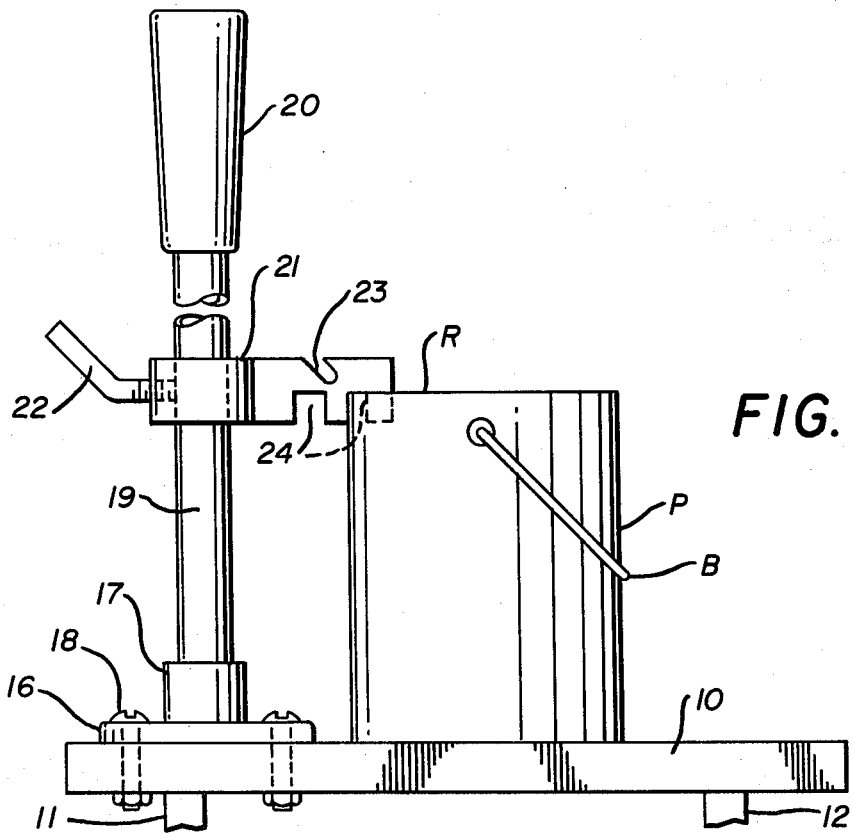
FIG. 2 is an enlarged side elevation of the device seen in FIG. 1 with the clamping member thereof in an alternate position.

By referring now to FIG. 2 of the drawings, it will be seen that the sliding clamp 21 has been moved downwardly on the post 19 and the clamping arm 22 reset to secure the sliding clamp 21 with one of the notches 24 engaged over the rim R of the paint bucket P. In such position the paint bucket P will be firmly held on the platform 10 of the step ladder.

It will occur to those skilled in the art that paint cans not provided with bails can be securely positioned on the step ladder 10 when the sliding clamp 21 is positioned to engage one of the notches 24 over the rim of the paint can. It will also be seen that any bucket having a bail may be hung from the sliding clamp 21 by engaging the bail in the notch 23 and that the arrangement is such that the bucket may be positioned beside the stepladder and the sliding clamp 21 repositioned on the post so that the portion having the notches 23 and 24 extends outwardly to one side of the step ladder so as to receive and hold the bail of a bucket so positioned.

It will thus be seen that a simple and efficient stepladder bracket has been disclosed which may be easily attached to a conventional step ladder and used both as a safety handle assisting a person climbing the stepladder and as a means of holding a paint can, a bucket or other object in desired position relative to the step ladder.

Although but one embodiment of the present invention has been illustrated and described, it will be apparent to those skilled in the art that various changes and modifications may be made therein without departing from the spirit of the invention.

Having thus described my invention what I claim is:

1. A step ladder bracket and vertically extending safety handle for a step ladder and comprising a horizontally flanged fitting for engagement on a horizontal portion of said step ladder, a vertical post detachably engaged in said fitting so as to extend above said step ladder to form said safety handle, a resilient hand grip on the upper portion of said vertical past, a sliding clamp on said post, said clamp having an annular body movably engaging said post and a horizontally disposed extension on said annular body, at least one notch in each of the upper and lower portions of said horizontally disposed extension, said notch in the upper portion of said horizontally disposed extension being positioned at a 45° angle with respect thereto so as to incline downwardly and outwardly with respect to said annular body of said sliding clamp so that a bucket bale engaged in said 45° slot will hold a bucket positioned on said horizontal portion of said step ladder, a rotatable threaded clamping arm engaged in a threaded opening in said annular body so as to engage said post whereby said notch in the lower portion of said horizontally disposed extension may be engaged over the rim of said bucket on said step ladder and said clamping arm secured to said post to hold said bucket on said step ladder.

* * * * *